US005193476A

United States Patent [19]

Namur

[11] Patent Number: 5,193,476

[45] Date of Patent: Mar. 16, 1993

[54] LENGTHWISE ADJUSTABLE WISHBONE FOR SAILBOARDS

[76] Inventor: Marc Namur, Im Harras 10, D-6100 Darmstadt, Fed. Rep. of Germany

[21] Appl. No.: 758,007

[22] Filed: Sep. 12, 1991

[30] Foreign Application Priority Data

Sep. 15, 1990 [DE] Fed. Rep. of Germany ..... 9013143

[51] Int. Cl.[5] ..... B63H 9/10

[52] U.S. Cl. ..... 114/98; 114/97

[58] Field of Search ..... 114/39.2, 97, 98, 102; 403/325, 327, 328, 399

[56] References Cited

U.S. PATENT DOCUMENTS 4,562,787 1/1986 Adamek et al. ..... 114/39.2
4,943,182 7/1990 Hoblingre ..... 403/328
4,984,995 1/1991 Tucker et al. ..... 403/328

FOREIGN PATENT DOCUMENTS 0317661 5/1989 European Pat. Off. .
09742 12/1988 World Int. Prop. O. ..... 114/97

*Primary Examiner*—Sherman Basinger
*Assistant Examiner*—Thomas J. Brahan
*Attorney, Agent, or Firm*—Young & Thompson

[57] ABSTRACT

For locking the extension spars 3 to the main spars 1, with a lengthwise adjustment of the wishbone of a sailboard selected in correspondence with the size of the sail, the outer sleeves 9, loosely seated on the extension spars 3, are pushed in the direction of arrow a onto the inner sleeves 5. During placement of the outer sleeves 9, the locking tongues 6 of the inner sleeve 5 are radially compressed by the clamping force exerted on the locking tongues 6 by the placement end 13 of the outer sleeve 9 by way of the clamping beads 7, so that locking ring segments formed at the free ends of the locking tongues 6 engage into the provided peripheral groove 10 of the extension spar 3; the flat annular segments 20 formed on the inside 18 of the teeth 15 of limited resiliency pertaining to the frontal serration 14 at the placement end 13 of the outer sleeve 9 lock behind the clamping beads 7, formed on the inner end sections of the locking tongues 6 at a spacing from the frontal serration 12, and the frontal serrations 12, 14 of the inner sleeve 5 and outer sleeve 9 enter into engagement so that the sleeves are locked together. The release of the locking devices is effected by rotating the outer sleeve 9 whereby the frontal serration 14 at the placement end 13 of the outer sleeve 9 slides out of the frontal serration 12 of the inner sleeve with simultaneous displacement of this outer sleeve in the direction of arrow d and releasing of the annular sections 20 of the teeth 15 at the placement end 13 of the outer sleeve 9 from the clamping beads 7 on the inner sleeve 5, and by simply pulling off the outer sleeve 9 from the inner sleeve 5.

2 Claims, 2 Drawing Sheets

LENGTHWISE ADJUSTABLE WISHBONE FOR SAILBOARDS

BACKGROUND OF THE INVENTION

The invention relates to a lengthwise adjustable wishbone for sailboards, with two main spars connected by a wishbone head section and with two extension spars adjustable in these main spars telescopically, these extension spars being joined on the stern line side by means of an elastic wishbone end section, as well as to devices for locking the spars, with the length of the wishbone being set in correspondence with the size of the sail, by means of respectively one inner sleeve fixedly connected to the ends of the main spars, such sleeve exhibiting locking tongues projecting beyond the end of the main spar in the axial direction with radially outwardly protruding clamping parts wherein radially inwardly protruding locking ring segments are formed at the ends of the locking tongues, these segments extending in the peripheral direction, and with an outer sleeve fashioned as a clamping sleeve, which can be locked with the inner sleeve, this outer sleeve, when pushed onto the inner sleeve, compressing the locking tongues arranged at the latter so that the locking ring segments formed at the locking tongues lock into peripheral grooves arranged at spacings on the extension spars.

In a lengthwise adjustable wishbone-shaped boom of this type, known from EP 0317661 Al, the outer sleeves equipped with an internal thread are threaded on the inner sleeves exhibiting a corresponding outer thread in order to lock the main spars to the extension spars. The trapezoidal seats primarily employed at present in sailboards bring about a strong torsional stress on the wishbone so that there is the danger that the meshing threads of the inner and outer sleeves will seize when the wishbone of this type is locked in place and consequently the locking engagement can be released only with great expenditures of force and frequently only with the aid of tools. Furthermore, the conventional locking mechanism is relatively expensive and cumbersome in handling.

The invention is based on the object of further developing the wishbone of this type with a view toward higher functional safety and simpler manipulation of the locking mechanism.

SUMMARY OF THE INVENTION

This object has been attained in accordance with this invention by a lengthwise adjustable wishbone having the features of claim 1.

The dependent claims contain suitable further developments of the invention.

The wishbone of this invention is distinguished by high functional safety, simple handling, and a simple structure.

BRIEF DESCRIPTION OF THE DRAWINGS

Further details of the invention can be seen from the following description of an embodiment illustrated in the drawings wherein.

DETAILED DESCRIPTION OF THE INVENTION

Figure 1:
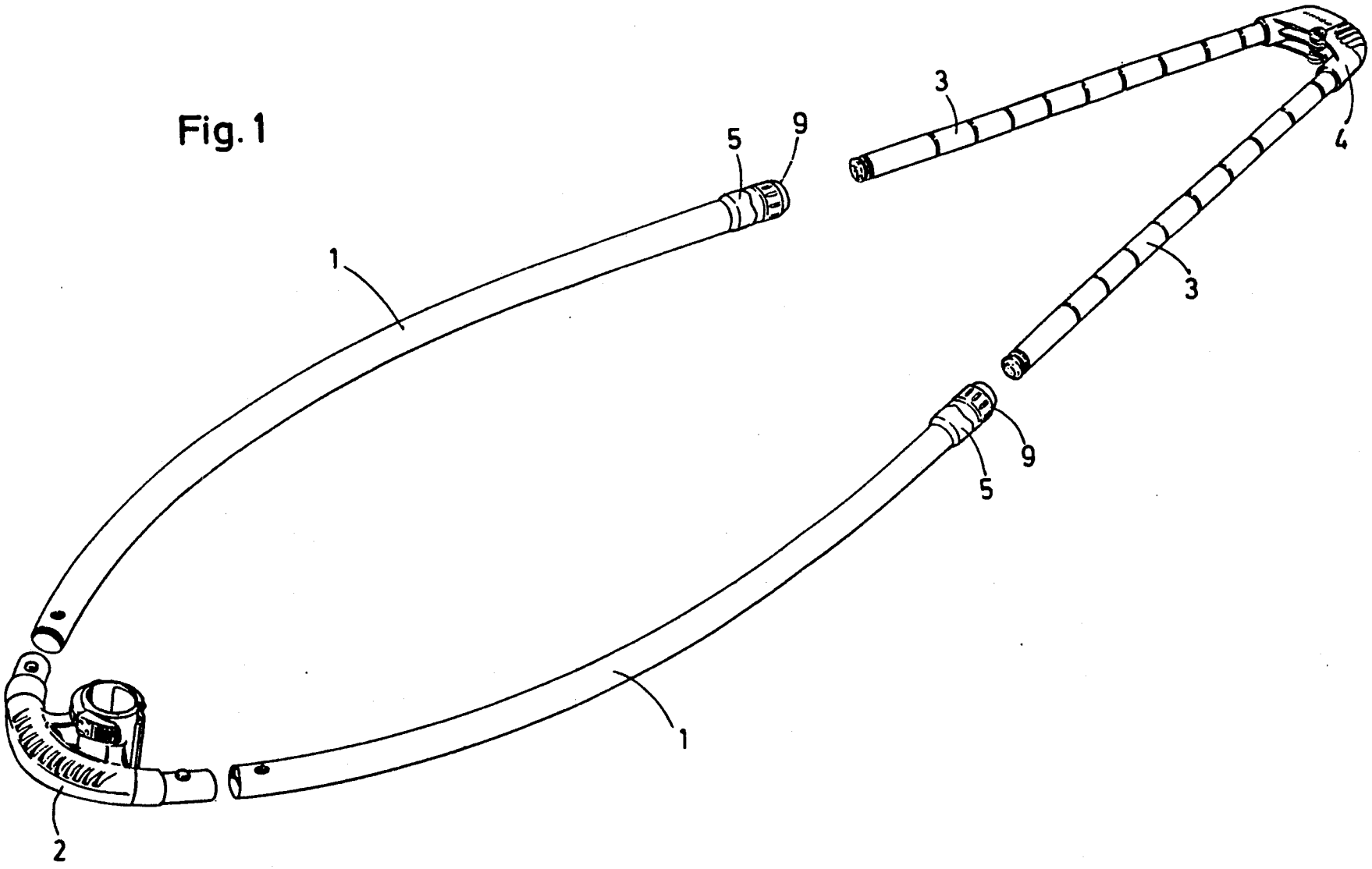
FIG. 1 is a perspective exploded view of the wishbone according to the invention.

The wishbone according to FIG. 1 consists essentially of two main spars 1 joined at an acute angle on the mast side by way of a wishbone head section 2, and two extension spars 3 received telescopically by the main spars 1 and joined together on the stern line side by way of an elastic wishbone end section 4.

The wishbone is attached, with the wishbone head section 2, to the mast of a sailboard and is held together by the sail rigging extending from the corner between the stern line and the bottom line of the sail to the wishbone end section 4.

Figure 2:
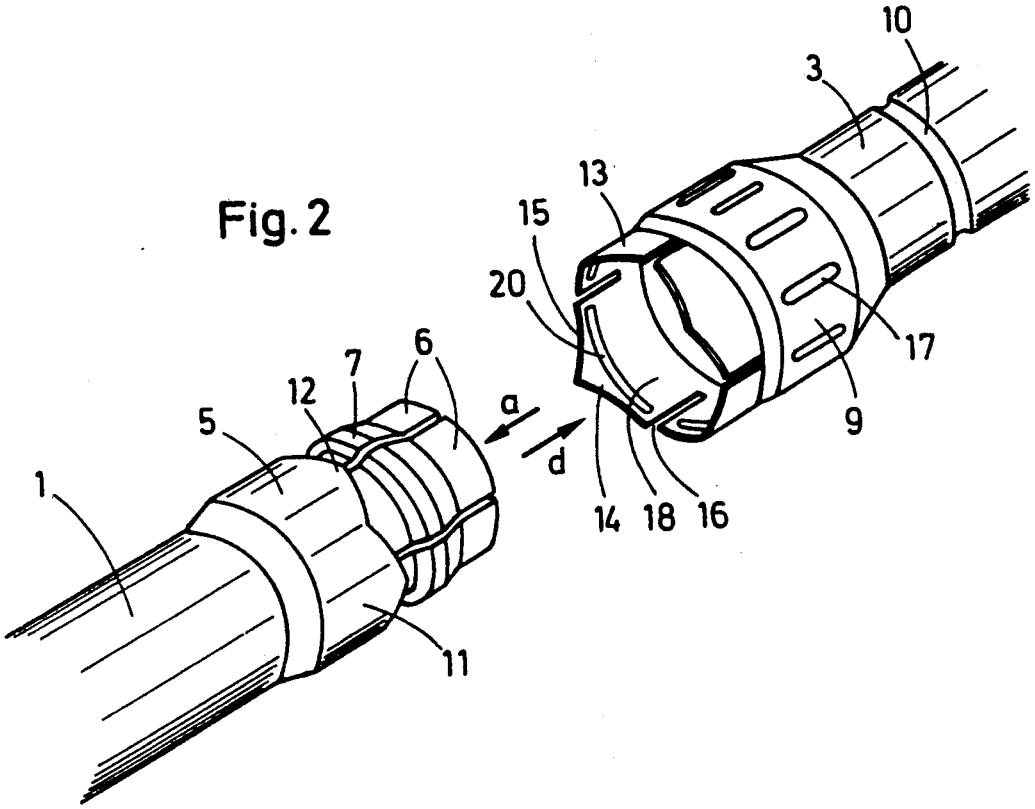
FIG. 2 is a perspective view of the locking device for the wishbone.
Figure 3:
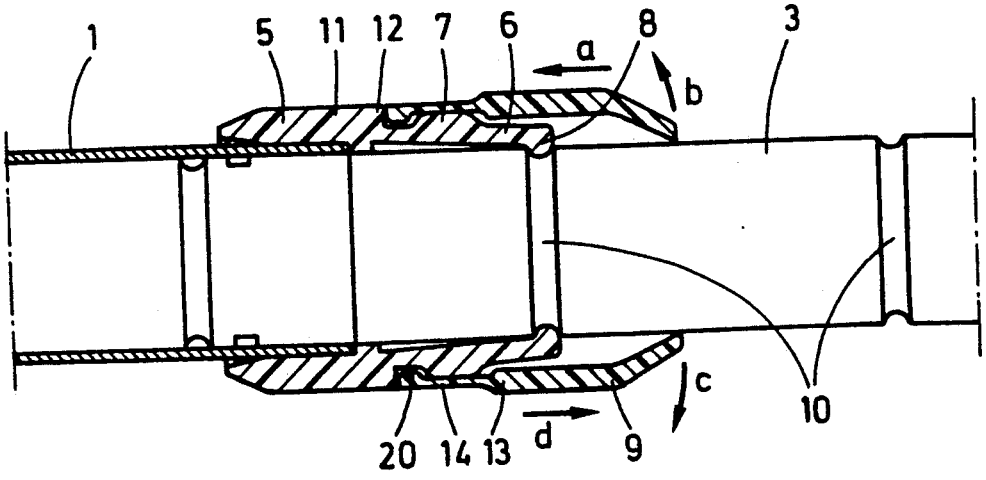
FIG. 3 is a longitudinal section of the locking device according to FIG. 2 on an enlarged scale.

The device according to FIGS. 2 and 3 for locking the extension spars 3 to the main spars 1 with the length of the wishbone adjusted in correspondence with the size of the sail comprises respectively one inner sleeve 5 firmly connected to the ends of the main spars 1 and having locking tongues 6 axially protruding past the end of the main spar 1; on the inner end sections of these locking tongues, radially outwardly projecting clamping beads 7 are formed, designed as annular bead segments, and peripherally extending, radially inwardly projecting locking ring segments 8 are formed at the free ends of these tongues.

The locking device furthermore includes an outer sleeve 9 fashioned as a clamping sleeve, by means of which, during placement onto the inner sleeve 5, the locking tongues 6 arranged at this inner sleeve are radially compressed by way of the clamping beads 7 so that the locking ring segments 8 formed at the locking tongues 6 lock into one of the peripheral grooves 10 arranged at a spacing on the extension spars 3.

The end of the inner sleeve 5 attached to the end of a main spar 1 exhibits a collar 11 with a flat frontal serration 12, and the engagement end 13 of the outer sleeve 9 has a corresponding counter serration 14, the teeth 15 of which are separated by axial slots 16.

Grasping indentations 17 are formed in the outer sleeve 9.

The inner sleeve 5 and the outer sleeve 9 of the locking device are manufactured as injection-molded plastic parts.

In order to lock the extension spars 3 to the main spars 1, with a lengthwise adjustment of the wishbone selected in correspondence with the size of the sail, the outer sleeves 9 seated loosely on the extension spars 3 are pushed onto the inner sleeves 5 in the direction of arrow a. During placement of the outer sleeves 9, the locking tongues 6 of the inner sleeve 5 are radially compressed by the clamping force exerted on the locking tongues 6 by the engaging end 13 of the outer sleeve 9 by way of the clamping beads 7; consequently, the locking ring segments 8 of the locking tongues 6 lock into the provided peripheral groove 10 of the extension spar 3, the flat annular sections 20, formed at the placement end 13 of the outer sleeve 9 on the inside 18 of the teeth 15 of limited resiliency pertaining to the frontal serration 14, lock behind the clamping beads 7 formed at a spacing from the frontal serration 12 on the inner end sections of the locking tongues 6, and the frontal serrations 12, 14 of the inner sleeve 5 and outer sleeve 9 enter into engagement so that the sleeves are locked together.

The releasing of the locking devices takes place by rotating the outer sleeve 9 in the direction of arrow b or c whereby the frontal serration 14 at the engagement end 13 of the outer sleeve 9 slides out of the frontal serration 12 of the inner sleeve, with a simultaneous displacement of the outer sleeve in the direction of arrow d and releasing of the ring sections 20 of the teeth 15 at the placement end 13 of the outer sleeve 9 from the clamping beads 7 on the inner sleeve 5, and by simply pulling the outer sleeve 9 off the inner sleeve 5.

I claim:

1. Lengthwise adjustable wishbone for sailboards comprising: two main spars connected by a wishbone head section and two extension spars adjustable in said main spars telescopically, said extension spars being joined on the stern line side by means of an elastic wishbone end section, means for locking the main spars to the extension spars, said locking means including respectively one inner sleeve fixedly connected to the ends of the main spars, and an outer sleeve seated loosely on the extesnion spars, said inner sleeve having locking tongues projecting axially beyond the ends of the main spar, radially outwardly protruding clamping beads, and radially inwardly projecting locking ring segments formed at the ends of said locking tongues, said locking ring segments extending in the peripheral direction, said outer sleeve having a placement end and adapted to be locked with the inner sleeve when pushed onto the inner sleeve by compressing the locking tongues so that the locking ring segments lock into one of several peripheral grooves arranged at spacings on the extension spars, said inner sleeve having a collar with a flat frontal serration, said placement end having a corresponding counter serration, said counter serration having teeth separated by axial slots, said placement end further including flat annular sections formed on the inside of the teeth which extend, in the locked position of inner sleeve and outer sleeve, behind the clamping beads, said clamping beads fashioned as annular bead segments and being formed on the inner end sections of the locking tongues at a spacing from the frontal serration, and being radially compressed when the inner sleeve and outer sleeve are in engagement.

2. Wishbone according to claim 1, further including grasping indentations formed in the outer sleeve.

* * * * *